United States Patent [19]

Thuresson

[11] Patent Number: 4,736,917

[45] Date of Patent: Apr. 12, 1988

[54] ATTACHMENT DEVICE FOR INSULATION

[76] Inventor: Jan Thuresson, P.O. Box 59, 163 91 Spanga, Sweden

[21] Appl. No.: 31,723

[22] Filed: Mar. 30, 1987

Related U.S. Application Data

[63] Continuation-in-part of Ser. No. 731,213, May 7, 1985, abandoned.

[30] Foreign Application Priority Data

Aug. 31, 1984 [SE] Sweden ..... 8404370

[51] Int. Cl.[4] ..... A47H 1/10

[52] U.S. Cl. ..... 248/205.3; 24/304; 156/71; 248/301; 248/339

[58] Field of Search ..... 248/205.3, 339, 301, 248/304; 156/71; 24/304

[56] References Cited

U.S. PATENT DOCUMENTS

| | | | |
|---|---|---|---|
| 1,651,392 | 12/1927 | Honigbaum | 248/301 X |
| 2,288,706 | 7/1942 | Herr | 248/301 X |
| 2,580,231 | 12/1951 | Lamm | 156/71 X |
| 3,016,224 | 1/1962 | Hall | 248/205.3 |
| 4,310,137 | 1/1982 | Frye | 248/205.3 X |

FOREIGN PATENT DOCUMENTS

| | | | |
|---|---|---|---|
| 408315 | 9/1966 | Switzerland | 248/205.3 |

*Primary Examiner*—J. Franklin Foss
*Assistant Examiner*—David L. Talbott
*Attorney, Agent, or Firm*—Sughrue, Mion, Zinn, Macpeak & Seas

[57] ABSTRACT

An attachment device for attaching insulation material to a wall or other surface comprises a flat portion (1) adapted to engage the wall (8) and to which a self-adhesive coating (2) such as a double-adhesive tape has been attached. The coating (2) has a protective film (3) on the side facing from the plate (1), said self-adhesive coating (1) being adapted, after the protective film has been stripped off, to be attached to the surface (8) to which the insulation (7) is to be attached. The attachment device is provided on the side situated opposite to the self-adhesive coating (2) with a flap (4) extending from the plate (1) and adapted to penetrate into and support the insulation (7).

The plate preferably comprises a metal sheet (1, 11) and a flap (4, 12) cut out thereof and bent out from the plane of the sheet.

3 Claims, 1 Drawing Sheet

ATTACHMENT DEVICE FOR INSULATION

This application is a continuation-in-part application of U.S. application Ser. No. 731,213 filed May 7, 1985, now abandoned, entitled Attachment Device for Insulation to Jan Thuresson.

The present invention relates to an attachment device for attaching insulation to a wall or other surface. The attachment device is applicable for various types of insulation such as plates or mats of glass or rock fibre, foamed plastic and the like.

For attaching insulation material to e.g. walls solutions or glue of asphalt or other material have previously been used, or cement, nails or washers.

For attaching insulation as mentioned, tools or facilities or equipment for applying glue and cement are required, e.g. a vessel and a brush or a roller, or tools such as a hammer, or both. It is a disadvantage that tools and facilities are needed for attaching the insulation, firstly because it involves the cost for material and various facilities, and secondly because preparatory and supplementary work is required.

The mentioned disadvantages are avoided by the invention in that no preparatory or supplementary work is required, and neither are tools. This is obtained in that the attachment device comprises a flat portion to which a self-adhesive coating has been attached, said coating having a protective film on the side facing from the plate and being adapted to be attached to the surface to which the insulation is to be applied, a flap protruding from the plate being provided from the plate on the side opposite to the self-adhesive side, said flap being adapted to penetrate into and support the insulation.

In a second embodiment of the invention the plate comprises a metal sheet and a flap cut out of the sheet and bent out from the plane thereof.

In a third embodiment the flap is provided with a sharp point to facilitate its penetration into the insulation material.

In a fourth embodiment the flap is cut out of the edge of a flat metal sheet.

In a fifth embodiment the flap is formed of a long band by a cutting made at an acute angle relative to the longitudinal axis of the band, the edge of the plate facing from the flap being formed by a generally perpendicular cutting.

In a sixth embodiment the flat portion has one or more through openings.

Figure 1:
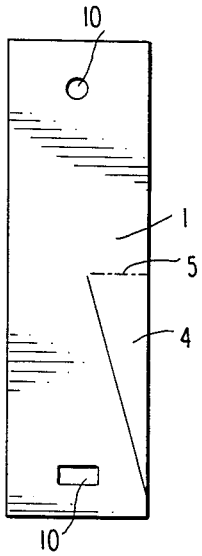
Figure 2:
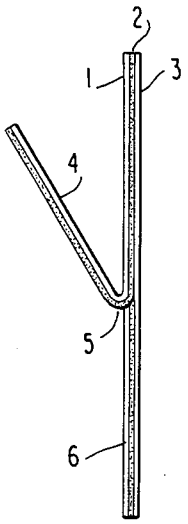
Figure 3:
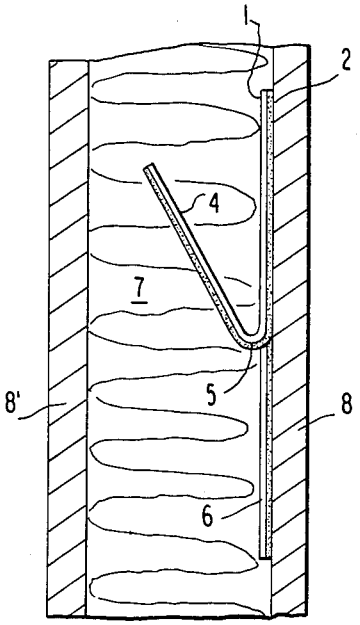
Figure 4:
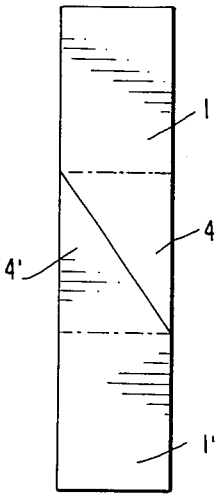
Figure 5:
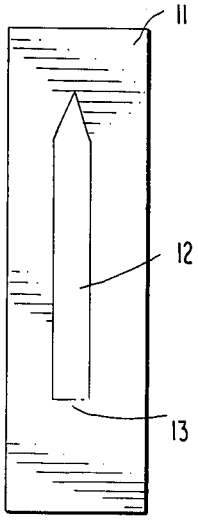
Figure 6:
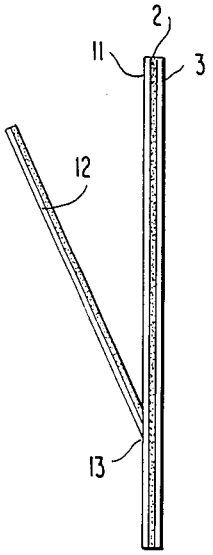

The invention will be described in more detail with reference to the accompanying drawings on which FIG. 1 is a front view of an attachment device according to the invention, FIG. 2 illustrates the same device in a side view and with a bent-over flap, FIG. 3 illustrates the device attached to a wall and supported insulation, FIG. 4 illustrates an embodiment with another shape of the flap, FIGS. 5 and 6 illustrate an embodiment with yet another shape of the flap.

In FIGS. 1 and 2, reference numeral 1 is the sheet or plate to which a double-adhesive tape 2 is attached. The tape has on the side facing from the plate a protective film 3 which can be removed when the attachment device is to be applied to a surface such as a wall to which the invention is to be affixed.

The design of the double-adhesive tape can be different, such as a thin film, or a strip of a suitable foamed elastomer, to provide good adhesion to a supporting surface even if it is uneven.

In the Figures, 4 is a flap cut out of the edge of the plate and through the double adhesive tape 2 and the film 3 such that a portion of the adhesive tape 2 and film 3 remains attached to the flap 4, and having a bend 5 at its lower portion (FIG. 2) such that the flap protrudes slightly from the plate which thus has an area 6 in which the double-adhesive tape is open. In the case of e.g. insulation plates of foamed plastic this area may increase the adherence of the insulation.

The attachment device is attached to e.g. the face of a wall in that the protective film on its rear side is stripped off and the plate is pressed to the wall, and the flap is bent, if this has not been done before, to a suitable angle so that the insulation material can be pushed onto the flap 4. The protective film adhering to the adhesive carried by the flap must be removed prior to pushing the insulation material onto the flap 4 where the adhesive readily adheres to the insulation 7. When the insulation comprises blocks of foamed plastic the flap 4 can be bent out perpendicularly to the plate and the insulation 7 can be pushed onto the flap perpendicularly to the wall. As shown in the Figure, the flat portion 1 has two completely through openings 10 which may be of an arbitrary shape and can be used for positioning the attachment device by means of a nail, a boss or other unevenness on the surface of the wall.

FIG. 3 is a section at right angle to a wall surface in the form of a wall panel 8 and illustrates the suspension of the insulation 7 by means of the device shown in FIGS. 1 and 2. When the insulation has been applied an additional wall panel 8' is usually attached to the open side of the insulation 7 shown on the left in the figure, such that the insulation is completely enclosed in the wall.

FIG. 4 illustrates an embodiment in which the attachment devices are cut out in pairs from a long metal band 1, 1' and the flap 4, 4' has the shape of a narrow, acute triangle. No waste of material occurs in the production of such attachment devices and the material is used to a maximum extent.

FIG. 5 illustrates an embodiment in which the plate 11 and the flap 12 are cut out of a flat metal sheet. FIG. 6 shows the same attachment device in a side view with the flap 12 bent out slightly from the plate 11 at the portion 13 shown in FIG. 5. The other reference numerals correspond to those previously used.

It is apparent that a person skilled in the art can modify the attachment device in a number of ways in addition to the examples shown above but still according to the subsequent claims.

I claim:

1. Attachment device for attaching insulation material to a wall (8) or other surface, consisting of a sheet metal flat plate (1) having a longitudinal centerline and opposite plate ends, said sheet metal flat plate further having a flat wall engaging surface, a self-adhesive double adhesive tape (2) attached to said plate wall engaging surface, said double adhesive tape having a side facing away from said plate, a protection film (3) on the side of said adhesive tape facing away from plate (1), at least one oblique line cut through said plate (1), said double adhesive tape (2) and said film (3) at an angle to the longitudinal centerline of the plate to define an integral flap (4) having at least a portion of generally V-shaped configuration being bendable relative to said plate for penetration into and support of the insulation (7) on said wall (8), and wherein removal of said protective film permits the side of the adhesive tape facing away from the plate on the plate to mount to a flat wall engaging surface while, removal of the protective film (3) from the integral flap (4) causes the exposed adhesive tape thereon upon penetration into said insulation to adhesively grip said insulation for facilitating attachment of the insulation material to the integral flap and as a result thereof to the wall (8).

2. Attachment device according to claim 1, wherein said at least one oblique line cut comprises a single cut from an edge of said plate inwardly thereof at an acute angle relative to the longitudinal centerline of the plate.

3. Attachment device as claimed in claim 1, wherein said at least one oblique line cut comprises a pair of oblique line cuts extending from positions on opposite sides of the longitudinal centerline of the plate and intersecting at said center line, and wherein the flap formed thereby lies intermediate of the ends of said plate, and wherein the oblique line cuts define a bend line therebetween for the flap at right angles to the longitudinal centerline of the plate.

* * * * *